US005484098A

United States Patent [19]

Anttila et al.

[11] Patent Number: 5,484,098

[45] Date of Patent: Jan. 16, 1996

[54] SPHERICAL LNG-TANK AND A PRODUCTION METHOD FOR SUCH A TANK

[75] Inventors: Jari Anttila, Turku; Jukka Gustafsson, Mynämäki; Matti Heinäkari, Turku; Jukka Linja, Merimasku; Matti Vaihinen, Turku, all of Finland

[73] Assignee: Kvaerner Masa-Yards Oy, Helsinki, Finland

[21] Appl. No.: 61,193

[22] Filed: May 13, 1993

[30] Foreign Application Priority Data

May 14, 1992 [FI] Finland ..... 922191

[51] Int. Cl.[6] ..... B23K 37/00; B23K 101/12; B21D 51/08

[52] U.S. Cl. ..... 228/184; 228/155; 72/364; 72/379.4; 72/700; 220/901

[58] Field of Search ..... 228/141.1, 155, 228/166, 184, 262.5; 72/364, 379.2, 379.4, 700; 220/901, 565, 584; 114/79 W; 62/45.1

[56] References Cited

U.S. PATENT DOCUMENTS

| | | | |
|---|---|---|---|
| 2,503,191 | 4/1950 | Branson | 228/155 |
| 2,579,646 | 12/1951 | Branson | 228/155 |
| 2,684,528 | 7/1954 | Rossheim et al. | 228/155 |
| 3,540,115 | 11/1970 | Geyer et al. | 228/155 |
| 3,729,812 | 5/1973 | Thomas | 228/155 |
| 3,938,363 | 2/1976 | Kelsey | 72/364 |
| 4,157,609 | 6/1979 | Schütz | 228/155 |
| 4,181,235 | 1/1980 | Baysinger | 220/5 A |
| 4,364,161 | 12/1982 | Stading | 228/155 |
| 4,555,055 | 11/1985 | Connolly | 228/155 |

FOREIGN PATENT DOCUMENTS

| | | |
|---|---|---|
| 2240949 | 8/1973 | Germany . |
| 3124514 | 1/1983 | Germany . |
| 152324 | 6/1985 | Norway . |

OTHER PUBLICATIONS

Metals Handbook Ninth Edition, vol. 6, Welding, Brazing, and Soldering, "Joint Design and Preparation", pp. 60–72, copy 1983.

*Primary Examiner*—Samuel M. Heinrich
*Attorney, Agent, or Firm*—Smith-Hill and Bedell

[57] ABSTRACT

A large spherical vessel is produced by welding commercially available large plane metal plates together to form a composite plane plate, cutting the composite plane plate to a form adaptable to a spherical surface, and thereafter forming the resulting composite plate blank to spherical form.

12 Claims, 7 Drawing Sheets

SPHERICAL LNG-TANK AND A PRODUCTION METHOD FOR SUCH A TANK

BACKGROUND OF THE INVENTION

This invention relates to a method for producing a large spherical vessel and to a vessel produced according to the method. In this specification and in the claims, the term "spherical" means having the form of any portion of the surface of a sphere.

The temperature of Liquefied Natural Gas (LNG) is about −163° C. This places special demands on the choice of material for a tank in which LNG is stored, on the design of the tank and on the technique used for producing the tank. Further, the tank must be self-supporting in order to minimize transfer of heat to the contents of the tank. The diameter of a typical spherical LNG-tank is 30–40 m. A tank suitable for transport and storing of LNG is usually also suitable for transport and storing of other fluids, provided that the pressure inside the tank is reasonable. Because the use of tanks for transport and storing of LNG places stricter demands, the invention is described in the following with reference to the demands placed explicitly by LNG, but this does not exclude the application of the invention for other suitable needs.

An LNG-tank is preferably made of aluminum plates, because the extremely low temperature does not negatively affect the strength of aluminum. Alternatively, also special steel alloys can be used, but this is noticeably more expensive and forming a steel plate to spherical form is more difficult than forming an aluminum plate to spherical form.

Any point on a spherical surface can arbitrarily be designated as a pole. Knowing the radius of curvature of the spherical surface, it is possible to define lines of longitude and latitude of the spherical surface relative to the pole.

Planar, rectangular plates suitable for use in construction of spherical tanks are commercially available from various sources. The largest such plate available from a particular source may conveniently be referred to as a standard plate. Such a standard plate is made by rolling as a unitary piece and is thus essentially homogeneous in composition. Even the largest commercially available standard plates suitable for construction of a spherical tank are rather small in size relative to the surface area of a large spherical tank. Accordingly at least about 100 such standard plates are needed to construct a large spherical tank.

Traditionally, a large spherical tank is assembled from commercially available standard plates by cutting each standard plate to a desired peripheral shape to form a plate blank, bending the plate blank to spherical form, and welding the spherical plate blanks together. This procedure is very demanding, because it is difficult to ensure that the bent plate blanks are indeed spherical, and deviations from the intended spherical form affect the welding procedure. Furthermore, handling procedures are noticeably more difficult when dealing with a spherical workpiece than when dealing with a plane workpiece. Most important, however, is the fact that it is difficult to weld spherical plates together and the shape and size of the plate blanks results in the length of welding joints between spherical plates being very great.

U.S. Pat. No. 3,938,363 discloses a method of forming a plate to spherical form employing a mold that comprises a lower convex die and an upper concave die. In accordance with that method, a plate of aluminum alloy is heated to a temperature of about 498° C. and is placed over the lower die. The upper die is lowered onto the hot aluminum plate, and the weight of the upper die causes the plate to be formed to the desired radius.

The lower die disclosed in U.S. Pat. No. 3,938,363 is constructed of a framework of steel plates defining rectangular cells, and the cells are filled with a refractory compound. The upper surface of the refractory compound is screeded to spherical form, the upper surface of the refractory material being approximately 5 cm above the upper surface of the steel plates. The concave die is of the same general construction as the convex die and is made using the convex die as a mold.

SUMMARY OF THE INVENTION

The object of the invention is to noticeably reduce the number of operations involving handling of spherical plates when assembling large spherical tanks.

According to the invention, selected portions of the largest available standard plates, or whole plates, are welded together in planar form to form a considerably larger composite plate. When welding the plates (or plate portions) together, conventional techniques can be used. The area of the composite plate is several, preferably at least three, times the area of a large standard plate. After the welding, the composite plate is cut to form a large plate blank of which the peripheral form is such that once it has been bent to spherical form it will fit the spherical plate pattern selected for the spherical tank without any further cutting. For example, the plate blank may be cut so that its edges, after bending, will be on lines of longitude and latitude of the spherical tank. In this fashion, the plate blank is adapted to construction of a spherical tank. After proper cutting, the large plate blank is bent to spherical form and can then be used without further machining as a large portion of a spherical tank. In this manner the number and length of welding joints necessary for welding together spherical workpieces are reduced noticeably, which substantially reduces the production costs of a spherical tank.

If the large plate blank made in the first step is so formed, that its length and width are nearly equal, the most suitable plate blanks for a spherical tank are produced. The result is of course dependent on the dimensions of the standard plates, so "nearly equal" may also encompass a difference between length and width of several meters. It has been established that the large plate blank assembled by welding preferably should have a size of about 100 $m^2$. Of course, the aim is to produce as large plate blanks as possible, but if the plate blank size is substantially larger than 100 $m^2$, bending it to spherical form may cause unreasonably great costs.

Before making the plate blank spherical, it should be provided with edge bevelings needed in a later welding phase. Also this kind of forming is easier to carry out on a plane plate blank than on a spherical plate blank.

The forming of the plate blank into spherical form is most conveniently carried out by heat forming at a temperature of 350°–460° C. Preferably, the forming temperature is 400°–430° C. In this temperature range, an aluminum plate suitable for the construction of a spherical tank can be bent into spherical form in a fairly simple device.

The heat forming may be performed using an oven that encloses the plate blank and its forming device. The oven is positioned by lowering it over the forming device. When the plate blank has reached the desired temperature, it should be kept constantly under forming pressure for about an hour, preferably for about two hours. In this way an effective forming is achieved and the tensions caused by the forming are evened out.

The cost of the forming device naturally depends on the size of the plate blank. A mold of the kind shown in U.S. Pat. No. 3,938,363 is rather expensive to build, due at least in part to the use of a large quantity of refractory material and the difficulty of accurately screeding the refractory material to the proper curvature. If a forming device large enough to allow forming of a plate blank composed of multiple standard plates were expensive to build, the cost of the forming device would add substantially to the cost of the eventual spherical vessel, thus offsetting the saving that arises from reducing the length of welding joints between spherical plates.

A mold for applying forming pressure to the plate blank may be formed of convex and concave dies, which serve as forming tools between which the plate blank is formed into spherical form. These dies may consist of plates placed on edge to form open grits, in which the edge form of the plates forming the grid determines the desired spherical form. It is preferred that each plate of the convex die and a counterpart plate in the concave die be made by cutting an arcuate slot in a single large plate. The width of the slot should correspond at least approximately to the thickness of the plate blanks that are to be bent by use of the mold. The slot in each plate is interrupted by short bridges. The bridges attach the two parts of the plate, at opposite respective sides of the slot, together. There are two groups of plates, one group to be used as longitudinal plates of the grid and one group to be used as transverse plates. The spacing of the bridges in the longitudinal plates is conveniently between 1 and 2 meters. In the transverse plates the spacing is such that there will be two bridges between two adjacent longitudinal plates when the grid has been assembled. The longitudinal plates are used as such for forming the grid but the transverse plates are cut into pieces fitting as transverse inserts into the grid, each with two bridges in the arcuate slot. The slot in each plate is of uniform radius of curvature. The bridges are quite short, about 3 cm.

The longitudinal and transverse plates are assembled to form a grid and are welded together at the grid's crossing points. The bridges are then cut, thereby separating the structure into a convex die and concave die. In this manner, a perfect mutual fit of the two dies is achieved, and very little plate material goes to scrap.

A forming die produced in this manner is relatively inexpensive, because the desired spherical form is created by cutting a relatively small number of plates along a circular curve, which is quite an easy procedure. The pitch of the die grid may be rather great. For instance, the distance between the plates may be about half a meter. In the regions of the mold at which the edges of the plate blank are placed, it is advisable to arrange, at least in the concave die, an additional support member that does not conform to the grid pattern of the die, because otherwise the edge region of the plate blank will not be formed effectively and uniformly enough, but will be slightly undulating, which is extremely inconvenient when the formed plate blanks are to be joined together by welding.

Generally, the required forming force can easily be produced by means of the weight of the upper die. Should this weight be too small, additional weight can be added in the forming phase or one may use, for instance, hydraulic means for increasing the downward directed force. Using additional weight is, however, the most simple and inexpensive solution. If additional weights are used, it is convenient to arrange the force transmission so that the additional weights can be located outside the oven space to act on the upper die from there. In this way no heat energy is wasted for warming up the additional weights, and further, the forming force can easily be controlled from the outside of the oven space.

Further, since the mold and the plate are heated concurrently in the oven, it is easy to ensure that the plate is at a uniform temperature when forming force is applied. Moreover, the undesirable possibility of local cooling of the plate due to its being brought into contact with a relatively cold die is avoided.

The invention also relates to an LNG-tank or the like which is produced by applying the described methods.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
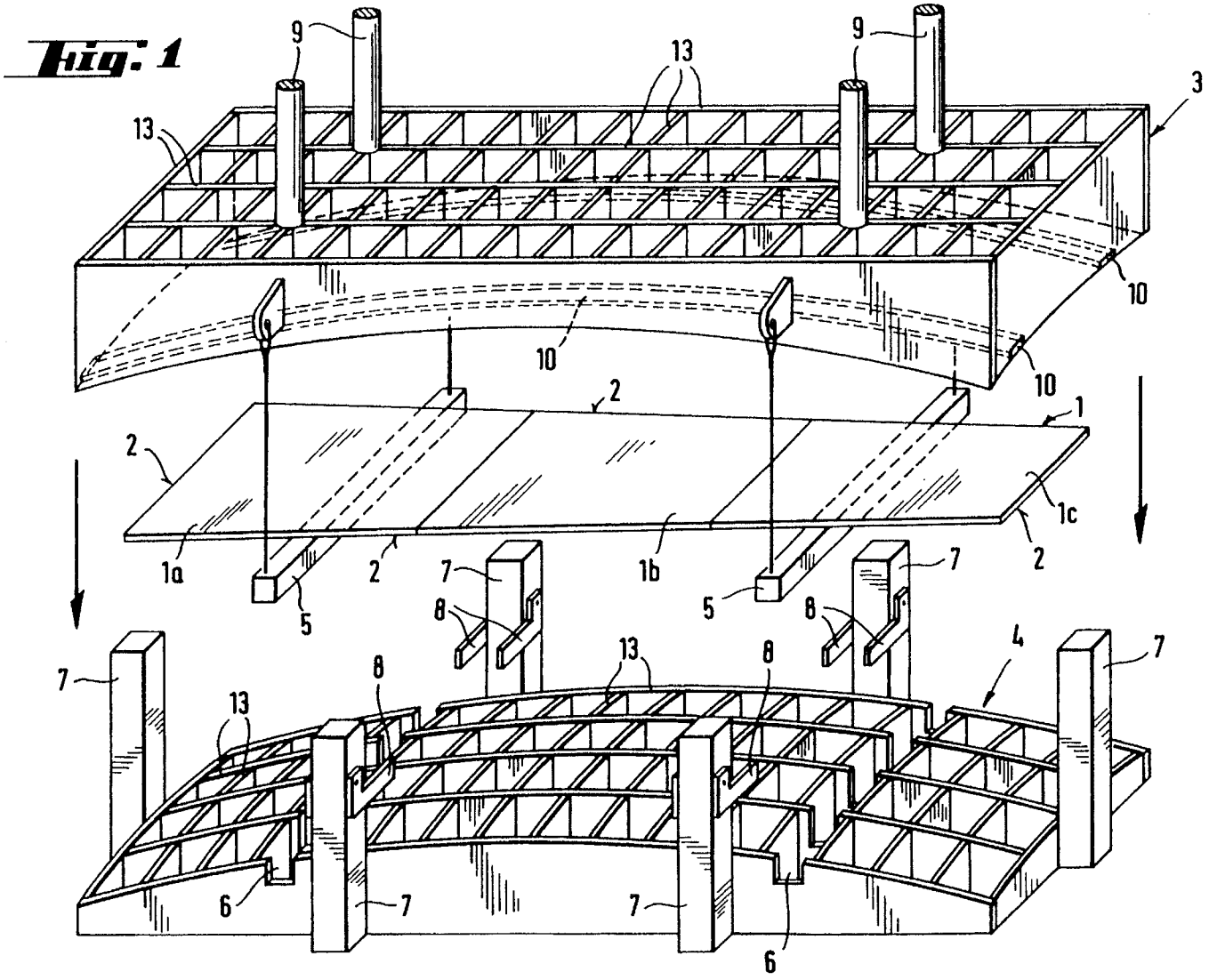
FIG. 1 schematically shows a mold and how a large plate blank that is to be bent to spherical form may be positioned in the mold, FIG. 2 schematically shows the mold in an oven space.

In the drawings, numeral 1 indicates a large composite plate blank assembled by welding together three standard plates 1*a*, 1*b* and 1*c*. The plate blank is shown in the drawing in elongated form, but this is only because the preferred almost square form is more difficult to show in perspective. The plate blank 1 is formed to later fit a spherical surface, and therefore its edges are slightly curved. The edges 2 of the plate blank are machined, typically beveled, to form a convenient groove for a welding joint that will be formed in a later welding operation.

Above the plate blank there is an upper die 3 with a concave bottom and below it a lower die 4 with a convex top is supported by a plane base (not shown). The upper die is moved into position by a crane and during this transfer the plate blank 1 is supported by supporting beams 5 hanging from the upper die 3. After the forming operation, the plate blank 1 is lifted up by means of the same supporting beams. The supporting beams 5 are housed in apertures 6 in the lower die 4 so that they do not interfere with the forming of the plate blank 1.

Several guide posts 7 are placed around the lower die, guiding the upper die. Some of the posts have a support element 8, which supports the upper die in its first positioning stage. At this stage, the plate blank 1 rests on top of the lower die without load. After the oven, described in more detail with reference to FIG. 2, has been placed with a crane over the dies and the forming temperature has been uniformly reached in the plate blank 1, the supporting elements 8 are released, whereby the weight of the upper die starts to act on the plate blank 1. Should this weight not be sufficient for performing the required forming, the upper die maybe loaded with additional weight, which could be, for instance, one or several steel plates 12 which are placed on loading posts 9 attached to the die 3.

As shown in FIG. 1, the dies 3 and 4 are made of plate grids so that the concave and convex edges of the grid walls determine the required spherical form. A forming die built in this way, where the pitch of the grid walls 13 is of the magnitude of half a meter, is not very expensive in spite of its large dimensions. Because the die grid does not fully correspond to the dimensions of the plate blank, additional supporting members 10 are needed at least in the concave die 3 at the edge region of the plate blank 1.

Figure 2:
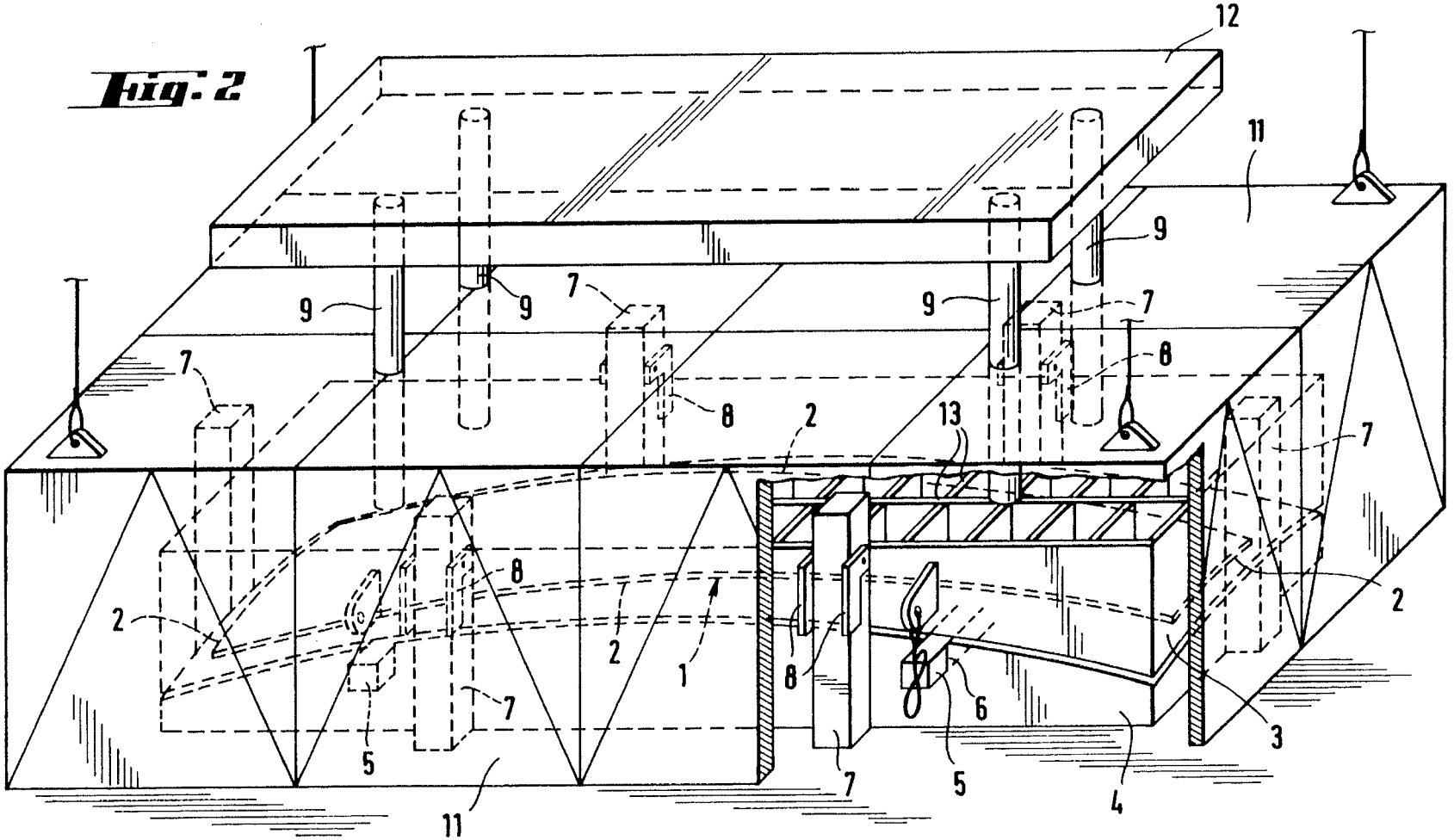

FIG. 2 shows the oven 11 over the dies 3 and 4. The oven can be a simple thermally insulated boxlike construction provided with necessary heating devices. The load posts 9 of the upper die pass through holes in the oven's top so that any additional weight that is eventually placed on them, remains outside the oven space. Using the load posts, the upper die can be raised and lowered while it is in the oven space, which is necessary in order to release the supporting elements 8 and lower the upper die into its loading position. FIG. 2 shows the supporting element 8 of one guide post 7 of the lower die in its released position, in which it is not supporting the upper die 3.

Figure 3A:
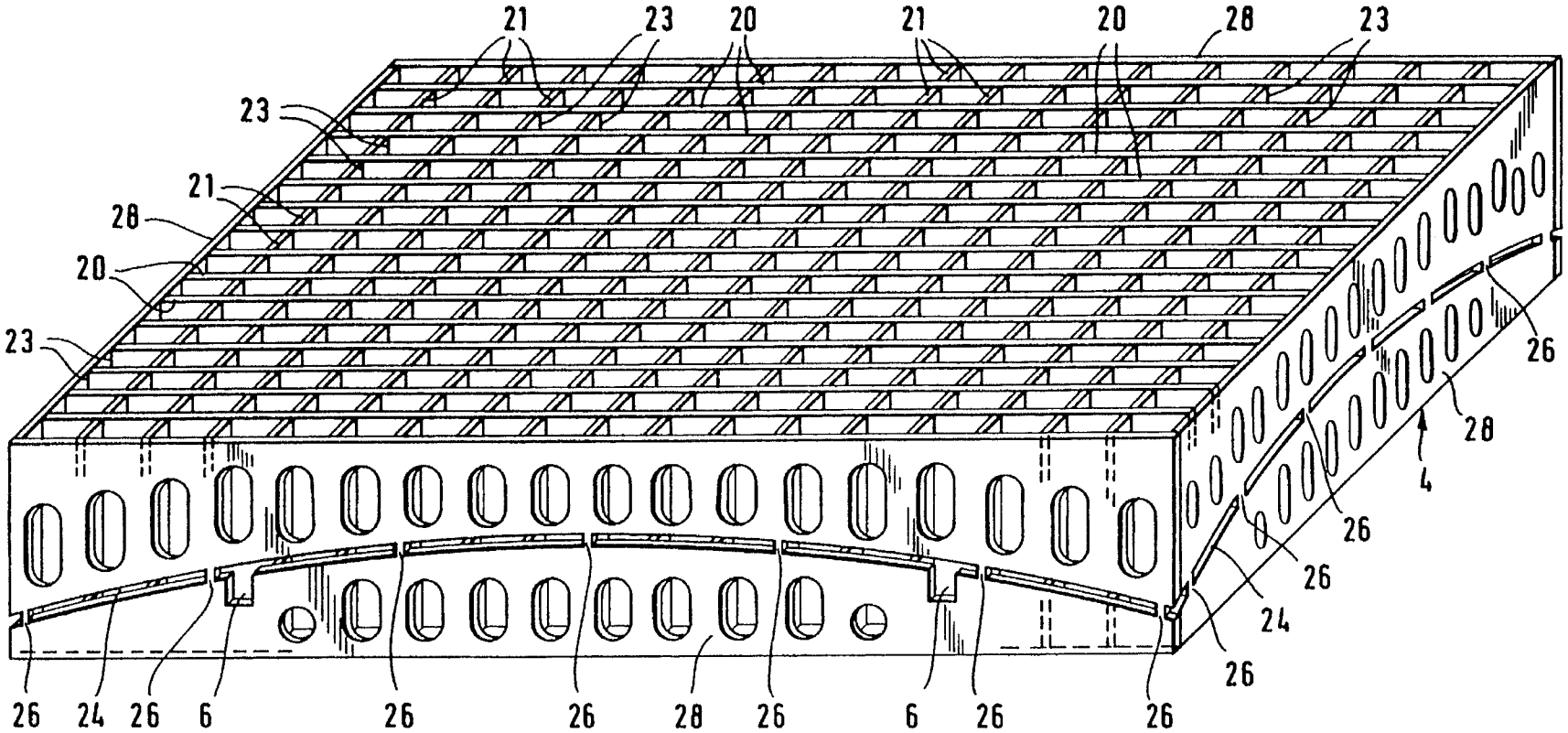
FIGS. 3A, 3B and 3C illustrate construction of the mold.
Figure 3B:
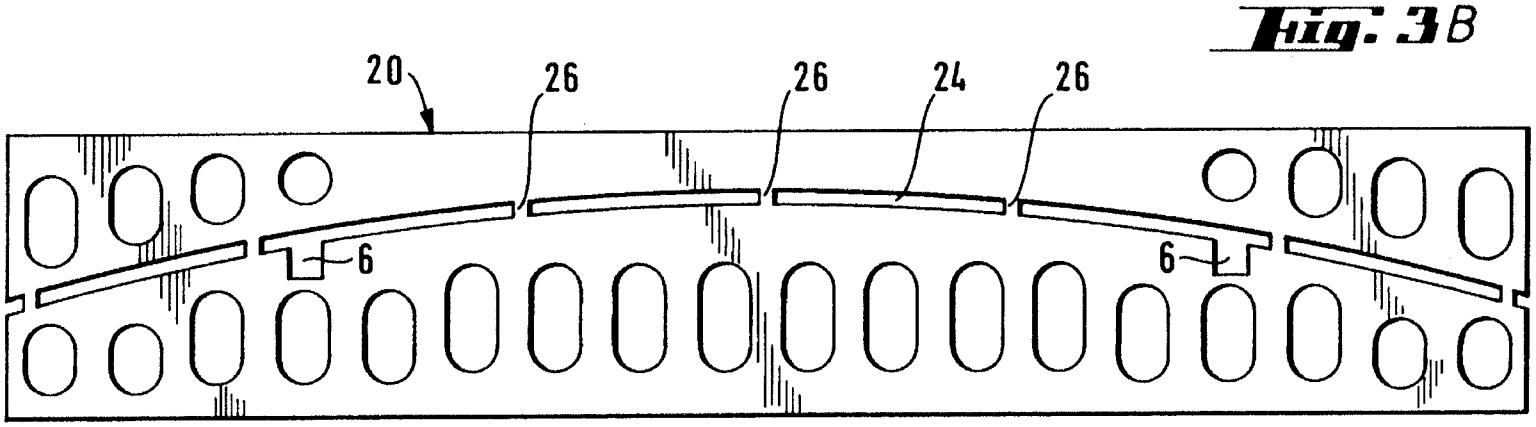
Figure 3C:
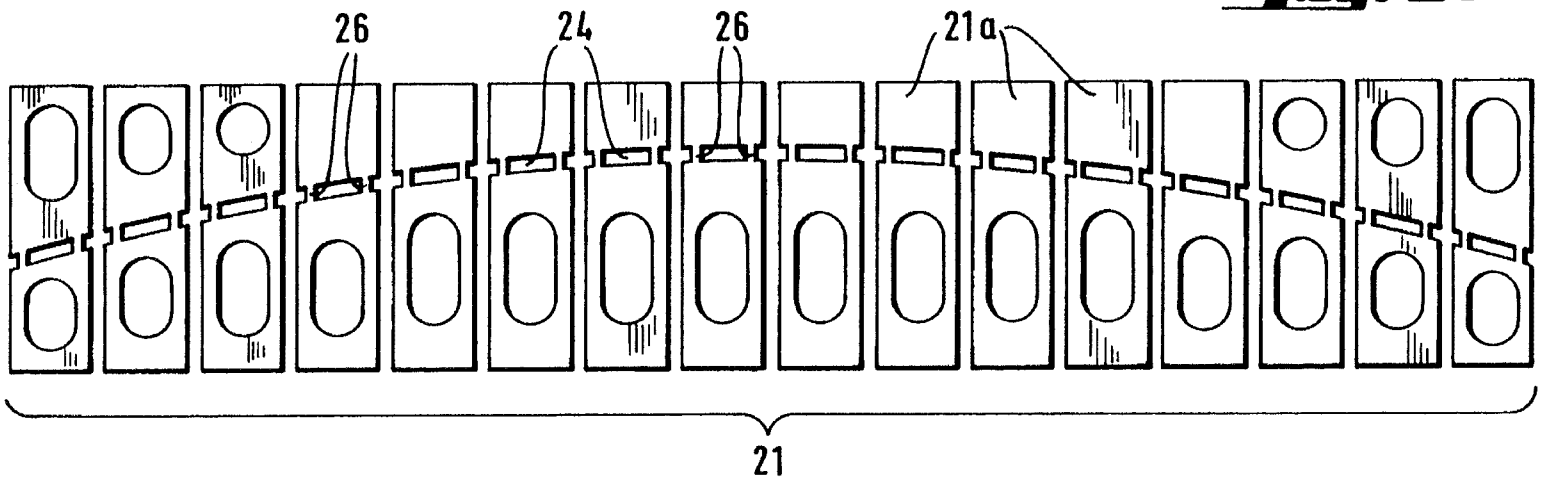

Referring to FIGS. 3A, 3B and 3C, the mold may be constructed from two sets of plates, longitudinal plates 20 and transverse plates 21, each provided with an arcuate slot 24 of uniform radius of curvature. The slots 24 are interrupted by short bridges 26. The width of each slot 24 corresponds approximately to the thickness of the plate blank that is to be bent using the mold.

The transverse plates 21 are cut into transverse inserts 21*a*, each having two bridges 26 in its portion of the arcuate slot 24. The plates 20 and the inserts 21*a* are fitted together to form a grid within an outer enclosure composed of plates 28 also provided with the same kind of arcuate slot 24. The plates 20 and the insert 21*a* are securely welded together at the grid's vertical crossing lines 23 and the bridges 26 are then cut, separating the grid into two portions that form the concave and convex dies respectively.

Figure 4:
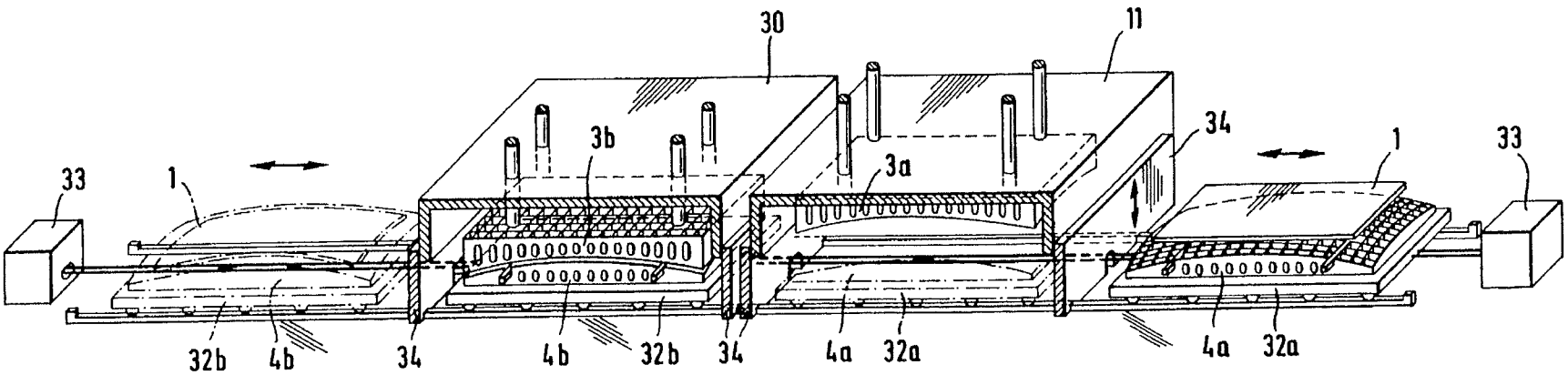
FIG. 4 illustrates a production line for bending large plate blanks to spherical form, employing both a forming oven and a cooling oven.

In the production line shown in FIG. 4, a separate cooling oven 30 is arranged in line with a forming oven 11 generally of the type shown in FIG. 2. The two ovens are stationary and each has two sliding doors 34 at opposite respective ends. Two concave upper dies 3*a*, 3*b* are located in the forming oven 11 and the cooling oven 30 respectively. The corresponding convex dies 4*a* and 4*b* are mounted on respective transport carriages 32*a* and 32*b*, each of which is connected to a driving cable running in a loop from one of the two winding drums 33 over a pulley (not shown) and back to the drum. Each oven is provided with a mechanism for raising and lowering the concave die and for raising and lowering the plate blank relative to the convex die. The dies are each about 12 m by 9 m when viewed in plan with the grid plates at a pitch of about 60 cm.

In operation of the production line illustrated in FIG. 4, the first plane plate blank is placed on the convex die 4*a* carried by the carriage 32*a*, and the die 4*a* and the plate blank are moved into the oven 11. The plate blank is bent to spherical form, in the manner described with reference to FIGS. 1 and 2, the concave die 3*a* is raised and the formed plate is lifted from the convex die 4*a* by use of supporting beams, as described with reference to FIGS. 1 and 2. The carriage 32*a* with the die 4*a* then returns to its initial position and the carriage 32*b* with the die 4*b*, which is identical in form to the die 4*a*, takes its place inside the oven 11. The formed plate blank is lowered onto the convex die 4*b* and the carriage 32*b* carries the die 4*b* and the formed plate blank into the cooling oven 30, where the plate blank is pressed between the concave die 3*b* and the convex die 4*b* during controlled cooling for about two hours. The concave die 3*b* is then raised and the carriage 32*b* carries the convex die 4*b* and the cooled, formed plate blank from the cooling oven 30. During the cooling of the first plate blank in the cooling oven, a second plate blank is bent to spherical form in the forming oven 11 by use of the dies 3*a* and 4*a*.

Figure 5:
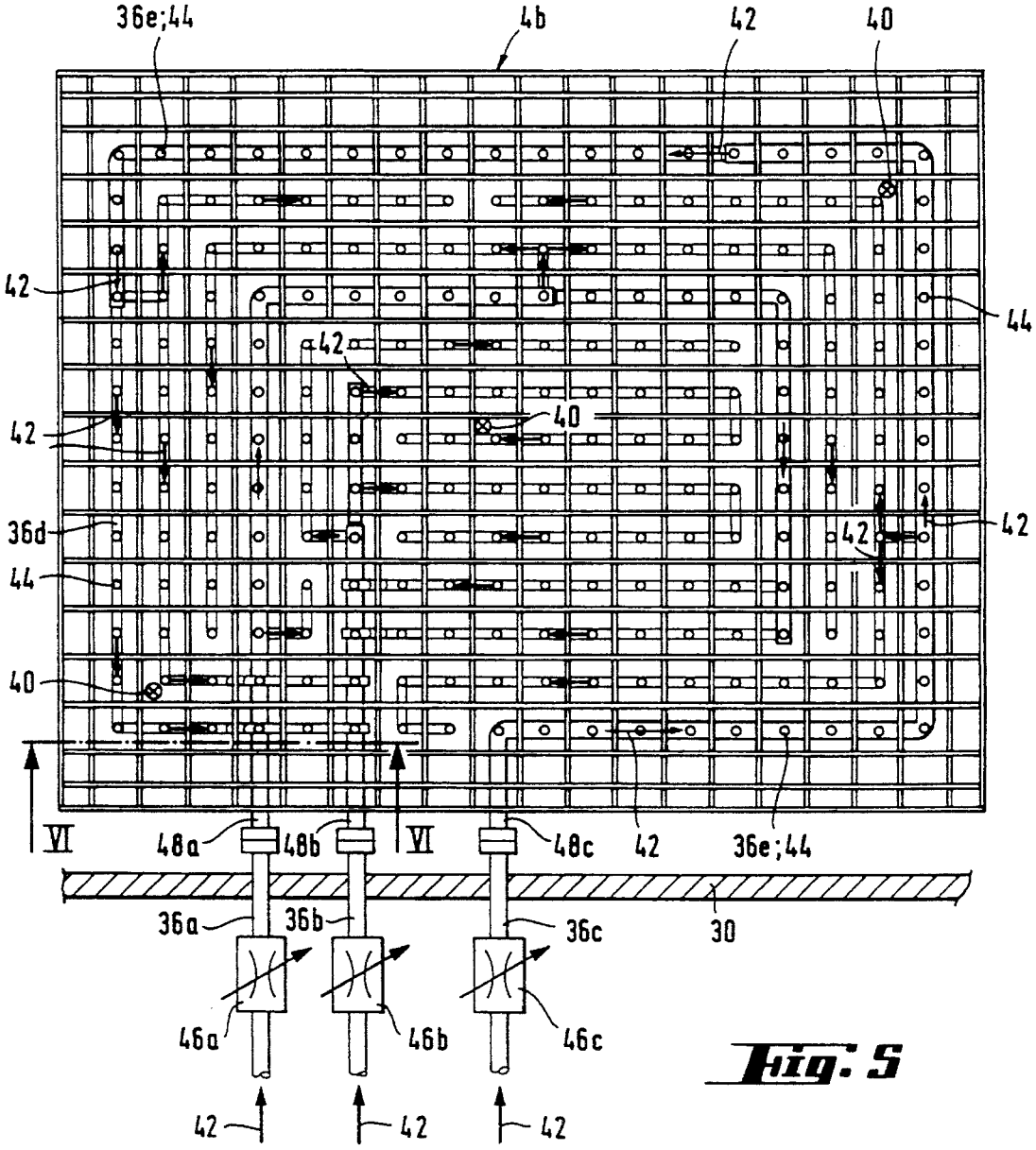
FIG. 5 is a plan view of a die that is used in the cooling oven.
Figure 6:
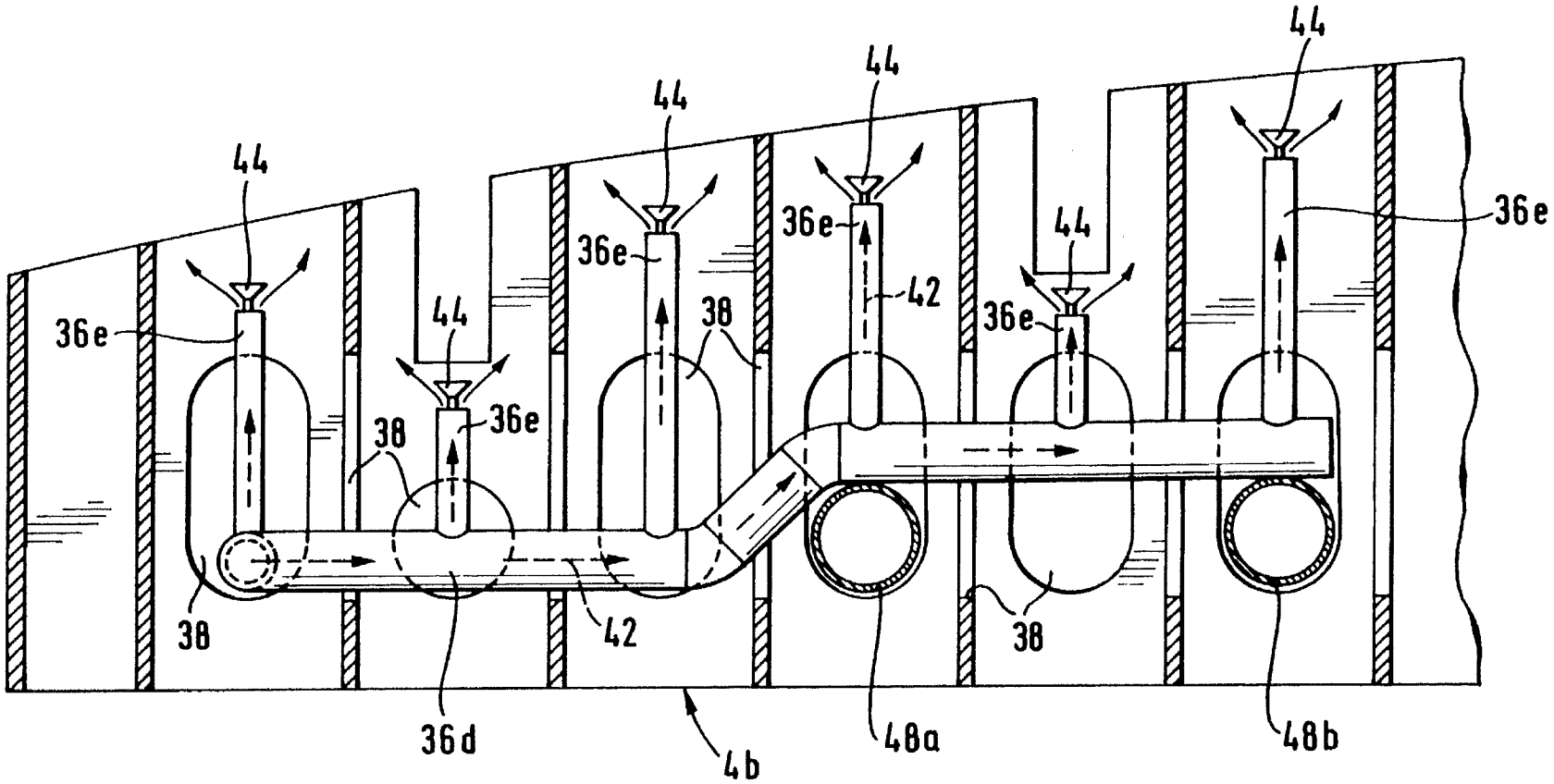
FIG. 6 is a sectional view taken on the line VI—VI of FIG. 5.

Air supply ducts 36*a*, 36*b* and 36*c* are installed in one wall of the cooling oven 30, and air is delivered to these ducts by means of fans (not shown) through controllable throttles 46*a*, 46*b* and 46*c*. The air supply ducts are each 250 mm in diameter and "the air flow through each air supply duct is about 1 cubic meter per second. When the carriage 32*b* is positioned in the oven 30, the ducts 36*a*, 36*b* and 36*c* register with extension ducts 48*a*, 48*b* and 48*c* respectively (250 mm diameter), which extend through passages formed in the die 4*b* by holes 38 in the grid plates. The ducts 48*a*, 48*b* and 48*c* are connected to further air distribution ducts 36*d* of 200 and 125 mm diameter. Each duct 36*d* extends generally horizontally and passes through at least one cell of the die 4*b*, and is provided with a vertical outlet tube 36*e* (50 mm diameter) in each cell through which it passes, as shown in FIG. 5. The outlet tubes 36*e* debouch below the formed plate, and each is provided at its upper end with a spreading member 44 for distributing the flow of air leaving the outlet tube. Air escapes from the lower die 4*b* through the holes 38 and is vented to atmosphere. The three duct systems connected to the ducts 36*a*, 36*b* and 36*c* respectively are separate and separately controllable. Arrows 42 show the air flow direction.

Controlled cooling means that the cooling is controlled in response to the temperature of the plate blank. Thus, temperature probes are provided for continuously measuring the temperature of the plate at selected measurement points 40, and at each measurement point 40, the temperature is measured separately at the two opposite sides of the plate 1. Operation of the fans for supplying air to the lower die is controlled in response to the temperature values so that the temperature at each measurement point follows a selected function of time during the cooling operation. Normally, three two-sided temperature measurement points are sufficient, one in the central area of the plate and one each at two diagonally opposite corner areas, as shown in FIG. 5. The temperature is measured at both sides of the plate in order to guard against the temperature difference becoming too great.

The production line shown in FIG. 4 provides the advantage that the forming oven 11 and the die 3*a* are not cooled when the plate blank is cooled, and accordingly energy for heating the oven 11 and the die 3*a* is saved. Further, although the carriage 32*a* and the die 4*a* are removed from the oven 11, they do not cool to ambient temperature before returning to the oven. By holding the blank in the proper spherical shape during controlled cooling, it is ensured that the blank will remain the proper shape when holding force is removed.

The invention is not limited to the method that has been described and explained, but several adaptations and modifications thereof are feasible within the scope of the attached claims. For example, the invention is not restricted to the entire tank being spherical and may be applied to a tank composed of two hemispherical portions joined by a cylindrical portion.

We claim:

1. A method for producing a plate blank for use in constructing a large vessel that is mainly spherical and has a predetermined radius of curvature, comprising:

(a) selecting a set of spherical portions of said predetermined radius of curvature, said portions being shaped so as to fit together, (b) welding rectangular plane plates or portions of such plates together to form a composite plane plate, (c) cutting the composite plane plate to form a composite plate blank having a peripheral shape such that on bending the composite plate blank to spherical form of said predetermined radius it conforms to the peripheral shape of one of said portions, and (d) forming the composite plate blank to spherical form of said predetermined radius by heat forming in an oven at a temperature in the range 350°–460° C.

2. The method according to claim 1, comprising repeating steps (b), (c), and (d) for each other spherical portion of the set, and welding the spherical composite plate blanks together to form a vessel that is mainly spherical.

3. A method for producing a large vessel that is mainly spherical, comprising welding standard plane metal plates, or portions of such plates, together to form a composite plane plates of which the area is substantially greater than that of a single standard plate, cutting the composite plane plate to form a composite plate blank of which the peripheral form is suitable for adaptation to a surface having the form of a portion of a sphere, and thereafter forming the composite plate blank to spherical form by heat forming in an oven at a temperature in the range 350°–460° C.

4. A method according to claim 3, comprising forming the composite plate blank to spherical form by heat forming at a temperature in the range 400°–430° C.

5. A method according to claim 3, comprising maintaining the composite plate blank continuously under a forming pressure and forming temperature for about an hour.

6. A method according to claim 5, comprising maintaining the composite plate blank continuously under the forming temperature and forming pressure for about two hours.

7. A method according to claim 3, comprising carrying out the heat forming by placing the composite plate blank between a convex die and a concave die, each of which has the general form of an open grid, whereby the edges of the grid walls define the shape of the dies.

8. A method according to claim 7, wherein adjacent grid walls of each die are about half a meter apart.

9. A method according to claim 7, wherein the concave die is provided between the grid walls with an additional support member for supporting an edge area of the composite plate blank.

10. A method according to claim 7, comprising applying forming force by using the upper die's weight.

11. A method according to claim 10, comprising applying additional forming force by using additional weight to load the upper die.

12. A method according to claim 11, wherein the additional weight acting on the upper die is located outside the oven space.

* * * * *